US005725070A

United States Patent [19]

Eldred

[11] Patent Number: 5,725,070

[45] Date of Patent: Mar. 10, 1998

[54] TRAILER-BASED SUPPORT FRAME FOR USE IN VERTICALLY TRANSFERRING PERSONS AND EQUIPMENT

[76] Inventor: Harold J. Eldred, 18 Burnham St., Terryville, Conn. 06786

[21] Appl. No.: 387,444

[22] Filed: Feb. 13, 1995

[51] Int. Cl.[6] ..... E04G 3/14; B66C 23/18

[52] U.S. Cl. ..... 182/63; 182/222; 182/230

[58] Field of Search ..... 182/63, 222, 230; 296/181

[56] References Cited

U.S. PATENT DOCUMENTS

| | | | |
|---|---|---|---|
| 974,381 | 11/1910 | Hogston | 182/230 |
| 3,093,210 | 6/1963 | Picard | 182/63 X |
| 3,825,095 | 7/1974 | Clark | 182/63 X |
| 3,871,477 | 3/1975 | Kuest | 182/63 |
| 3,937,301 | 2/1976 | Bertail | 182/63 X |
| 4,239,253 | 12/1980 | Golze | 296/181 X |
| 4,274,507 | 6/1981 | Williams | 182/63 X |
| 4,276,956 | 7/1981 | Mamula et al. | 182/222 X |
| 4,293,054 | 10/1981 | Pieri | 182/63 |
| 4,311,208 | 1/1982 | Macrorie et al. . | |
| 4,397,373 | 8/1983 | Ream et al. | 182/63 X |
| 4,442,919 | 4/1984 | Fulcher | 182/63 |
| 4,502,725 | 3/1985 | Wiant | 296/181 |
| 4,588,148 | 5/1986 | Krauchick | 182/63 X |
| 4,589,523 | 5/1986 | Olson et al. | 182/234 |
| 4,660,679 | 4/1987 | Ostrobrod | 182/18 |
| 4,811,803 | 3/1989 | Green | 182/63 X |
| 4,838,439 | 6/1989 | Baziuk . | |
| 5,022,489 | 6/1991 | Sauber . | |
| 5,295,557 | 3/1994 | Taylor | 182/222 |
| 5,484,035 | 1/1996 | Wildner | 182/63 |

FOREIGN PATENT DOCUMENTS

| | | | |
|---|---|---|---|
| 325332 | 3/1972 | U.S.S.R. | 182/222 |
| 1045144 | 10/1966 | United Kingdom | 182/222 |

*Primary Examiner*—Terry Lee Melius
*Assistant Examiner*—Christopher J. Novosad
*Attorney, Agent, or Firm*—Alix, Yale & Ristas, LLP

[57] ABSTRACT

Disclosed herein is an apparatus for facilitating vertical entry into a confined entry space such as a manhole. The apparatus includes a trailer-type base, a support frame formed on the base for supporting a hoisting device, and stabilizing posts for stabilizing the support frame. The apparatus preferably also includes a barricade mounted on the base for preventing accidental entry into an area beneath the support frame, and can include a support arm for vertically transporting a weight over an edge. The apparatus provides for convenient entry into a manhole by a worker while preventing accidental entry by a pedestrian, and also can be used for raising and/or lowering persons and/or objects over the edge of a wall, cliff, or pit.

15 Claims, 4 Drawing Sheets

TRAILER-BASED SUPPORT FRAME FOR USE IN VERTICALLY TRANSFERRING PERSONS AND EQUIPMENT

BACKGROUND OF THE INVENTION

The present invention generally relates to a trailer-based support frame for use in vertically transferring persons and equipment, and more particularly to a support frame of this type which has features that promote safety and provide added convenience.

Devices which are known for use in supporting a person or object to be inserted in an opening in the ground, such as a manhole for a drain or sewer, generally are portable tripods such as those which are disclosed in U.S. Pat. No. 4,660,679, Ostrobrod, and U.S. Pat. No. 4,589,523, Olson. A considerable amount of time is required in order to set up such tripods. Furthermore, tripods of this general type may have instability problems. Finally, there is no safety system incorporated into known tripods to prevent accidental entry of objects and/or persons into the manhole while the manhole is open.

SUMMARY OF THE INVENTION

An object of the invention is to provide a support frame which allows for convenient entry into, and exit from, an opening such as a manhole.

Another object of the invention is to provide a safety device which prevents accidental entry of persons and/or objects into an opening such as a manhole.

Yet another object of the invention is to provide an apparatus for use in entering a confined entry space which requires a smaller work crew than is needed when conventional equipment is used.

Yet another object of the invention is to provide a support device for use in entering a manhole, which device is easily transported.

Yet another object of the invention is to provide an apparatus for use in transporting a person or object vertically, which apparatus can be positioned for use by a worker without requiring heavy or overhead lifting.

A further object of the invention is to provide an apparatus for use in entering a manhole and the like which can be set up conveniently in a few minutes.

Other objects will be in part obvious and in part pointed out more in detail hereinafter.

The invention in a preferred form is an apparatus for use in vertically transporting a weight. The apparatus includes (1) a trailer-type base which is configured to be towed by a vehicle, (2) support means formed on and rigidly connected to the base, the support means being configured for supporting a hoisting device, and (3) stabilizing means for stabilizing the support means. In a particularly preferred form, the apparatus further includes (4) barricade means formed on the base for preventing accidental entry into an area below the support means. The apparatus also preferably comprises (5) platform means adjacent to the support means.

The barricade means preferably includes a cage-type barrier. The barricade means preferably has a door and can be part of the support means.

The support means preferably has an igloo-shaped top supporting one or more loops, which in turn support winches.

The invention accordingly consists in the features of construction, combination of elements and arrangement of parts which will be exemplified in the construction hereafter set forth and the scope of the application which will be indicated in the appended claims.

DETAILED DESCRIPTION OF THE INVENTION

Figure 1:
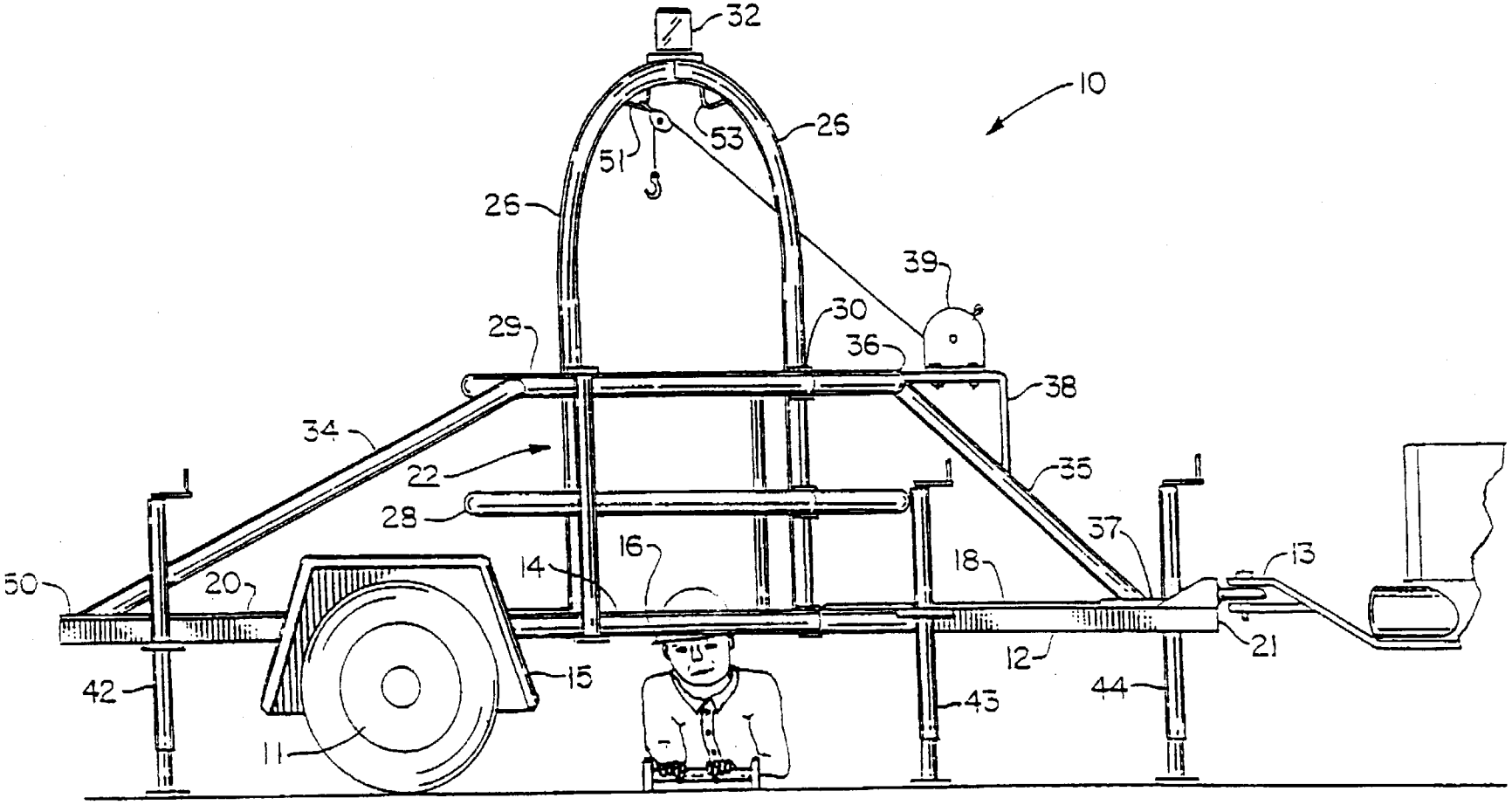
FIG. 1 a side elevational view of a first preferred embodiment of a support frame according to the invention.
Figure 2:
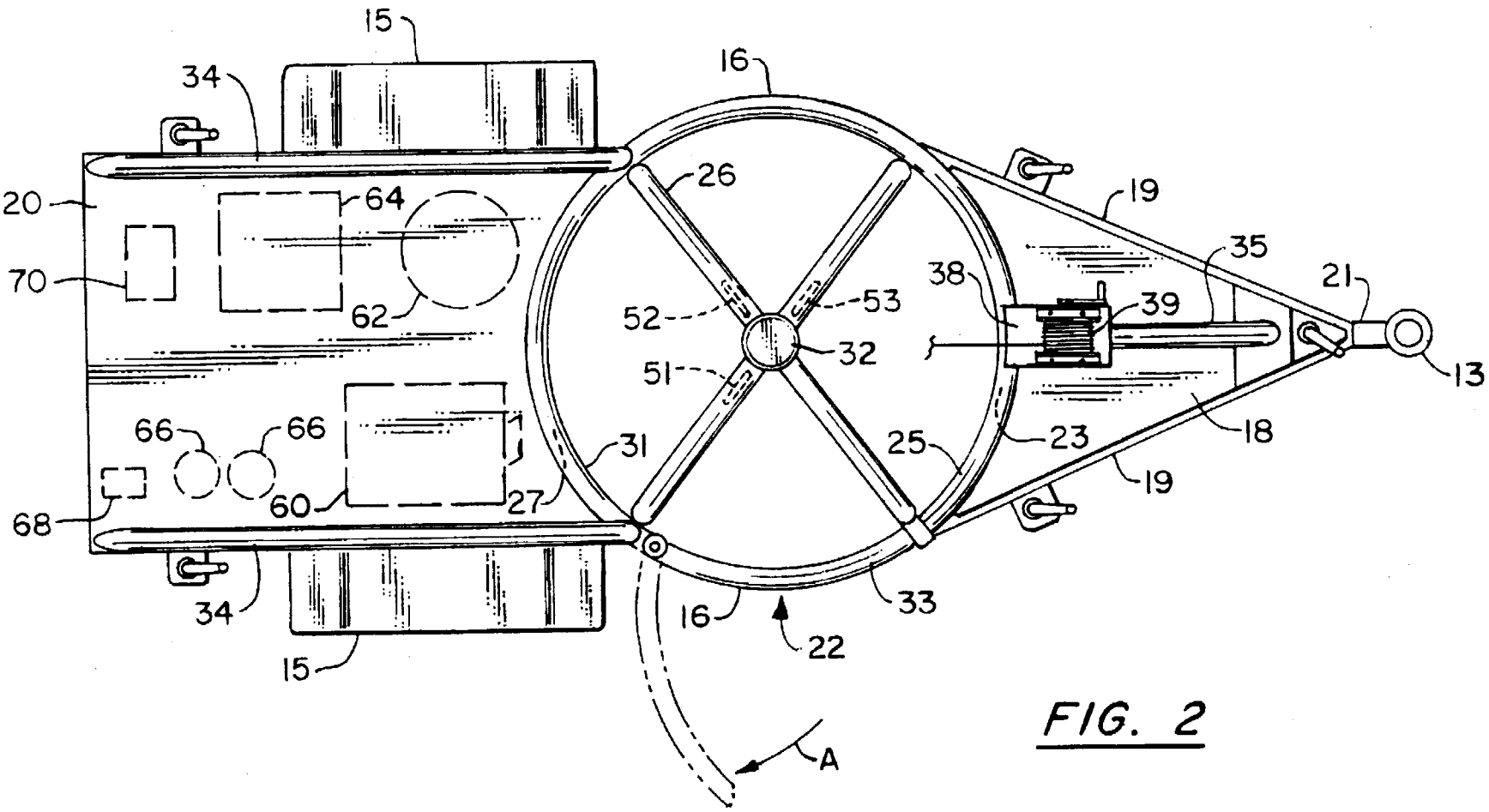
FIG. 2 is a top view of the embodiment of FIG. 1, additionally schematically showing the inclusion of accessories on the rear platform.
Figure 4:
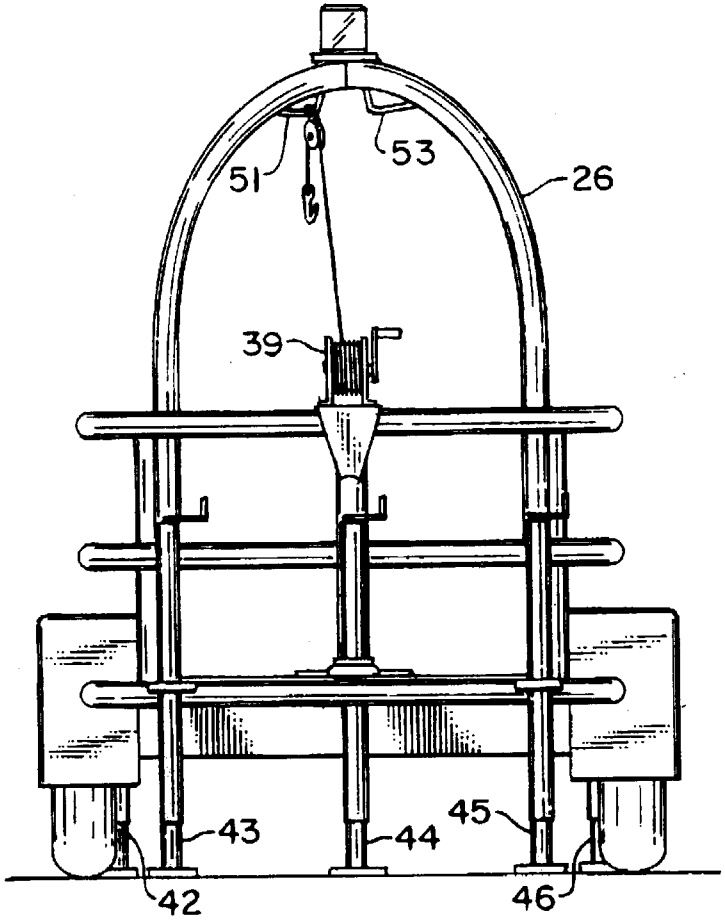
FIG. 4 is a front elevational view of the apparatus shown in FIG. 1.
Figure 3:
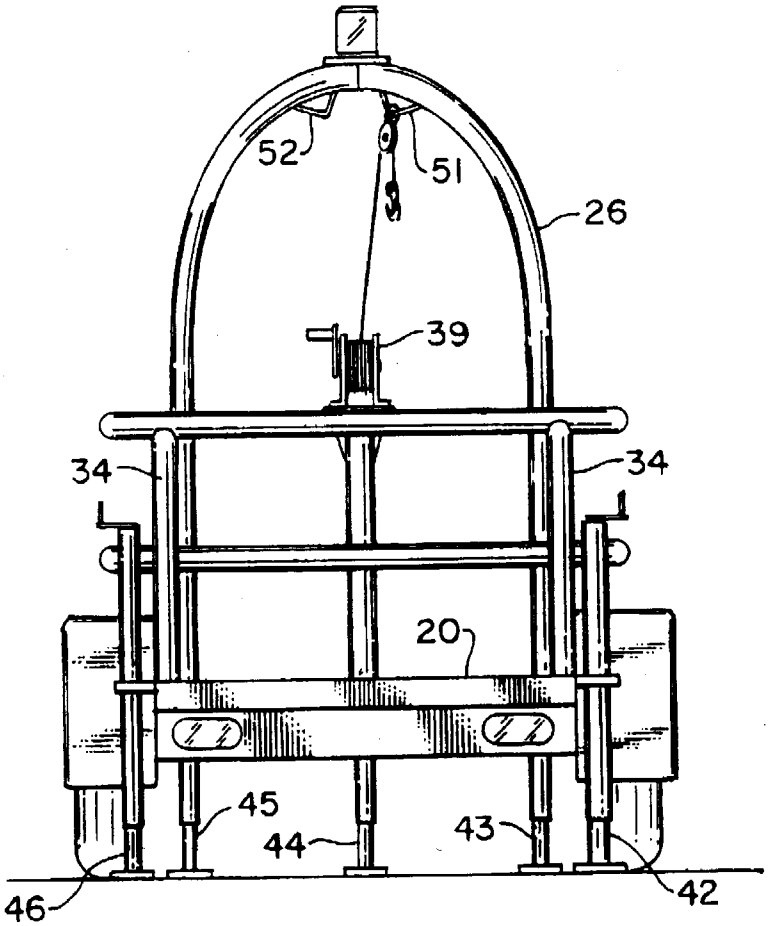
FIG. 3 is a rear elevational view of the apparatus shown in FIG. 1.

The support frame of the invention provides for quick, convenient and safe vertical entry into, and exit from, a confined entry space such as a manhole. The apparatus of the invention is designed for faster and easier set-up and removal, as well as greater safety than prior known equipment which is used when manhole entry is required. As a result of easy set-up, the risk of injury is minimized. Furthermore, the support frame of the invention is advantageous in that it allows for use of a smaller work crew at a manhole site than is required when a conventional support device is used.

Referring now to the drawings and in particular to FIGS. 1–4, a preferred embodiment of a safety manhole guard and winch support in accordance with the present invention is shown and is designated as 10. The guard and support 10 includes a horizontal trailer-type base 12 having two wheels 11 and a front tow 13. The wheels have flat-topped fenders 15 which provide a horizontal surface for supporting accessories during work. If necessary, the trailer-type base 12 can be configured with dual sets of wheels on parallel axles for added support and stability.

The base 12 has a central, round opening 14. Opening 14 is sized to permit passage of a person and equipment into a manhole, and typically has a diameter of about 5–6 feet. Opening 14 is defined by a pair opposite, curved side rails 16, each having the shape of one quarter of a circle, and a horizontal front platform 18 and a horizontal back platform 20, each of which has a cut-out portion in the shape of one quarter of a circle, as explained further below. Front platform 18 and back platform 20 form part of the base 12.

The front platform 18 is configured for a person to stand on and be within sight, radio or shouting distance of a worker who is in the manhole. The front platform has a pair of forwardly tapering sides 19 which terminate at a front apex 21. The rear end 23 of the front platform has a reinforced edge 25 in the shape of a quarter of a circle which, as mentioned above, defines a portion of the opening 14.

The back platform is generally rectangular, and has a reinforced edge 31 at an indented front end 27 which has the shape of a quarter of a circle. The back platform 20 is sized to carry equipment to be used for entering and working in a manhole. For example, the platform typically will hold a ventilator and hose 60, breathing air tank 62, tool box 64, which preferably is bolted to the platform 20, cones 66, and a noteboard 68 containing papers to be signed off in checklist form in order to ensure that the job meets OSHA regulations. Furthermore, a battery 70 can be carried for powering a light source to be taken into the manhole.

A cage-type barricade 22 is provided above and around opening 14 in order to prevent persons and objects from accidentally falling into an open manhole. The barricade 22 includes a plurality, i.e. preferably 4, uprights 26 which are fixed to the base 12 and extend vertically upward from the base at the perimeter of opening 14 for a height of about 4–6 feet. The uprights 26 then continue to extend upward and curve inward in an igloo-shaped configuration, intersecting at the top of the manhole guard 10 at a height of about 7–9 feet from the ground in order to form a sturdy support. The uprights 26 define a manhole entry space above a manhole. When viewed from the front, back or side of the trailer, opposite uprights 26 join to form an upside-down U-shaped, or igloo-shaped, support. The uprights 26 are further supported by a pair of upper side rails 28, 29 which extend horizontally in a circular manner around the uprights 26 and are welded or otherwise fixed thereto. The upper side rails 28, 29 are positioned directly over the opening 14 and preferably surround a circular space having generally the same diameter as the opening 14. The upper side rails 28, 29 are at a height appropriate to prevent persons from accidentally falling into the manhole. Typically, the lower of the two upper side rails, i.e. rail 28, is positioned at a height of about 2–4 feet from the ground, and the higher of the upper side rails, i.e. rail 29, is about 3–6 feet from the ground. The portions of the upper side rails 28, 29 which are on the curb side of the trailer, combined with at least a portion of side rail 16 on the curb side of the trailer, form a pivoting door 33 which can be opened as shown at arrow A and closed in order to facilitate entry of a worker who is to enter the manhole. The door 33 preferably is hinged and can be fastened shut with any suitable latch mechanism. For example, binder latches 30 can be used. The side rails 28, 29 and uprights 26 can be made, for example, of 2" schedule 80 pipe comprising chromalloy, aluminum or stainless steel.

A safety light 32 is mounted at the top of the four-way intersection of the uprights to warn traffic of the presence of the manhole guard and winch support 10 on the street. An umbrella-type cover (not shown) which preferably has a hole for the safety light 32, can be placed over the barricade 22 during rain or snow. The cover could be made, for example, of clear plastic.

The upper side rail 29 is further supported by a front diagonal support beam 35 and a pair of rear diagonal support beams 34. The front diagonal support beam 35 extends from the front end 36 of the upper side rail 29 to the front end 37 of the front platform 18. At its upper end, the diagonal support beam 35 supports a winch mount 38 on which is mounted a winch 39. Winch mount 38 includes a horizontal platform portion, which is attached to the upper end of support beam 35 for supporting the winch, and a generally vertical portion which bears against and is attached to the support beam 35 at a lower point.

The rear diagonal support beams 34 extend along the right and left sides of the back platform and are connected to the upper side rail 29 and to the rear edge 50 of the back platform. The rear diagonal support beams 34 are generally parallel to each other and provide support for the upper side rail 29.

Three support loops 51, 52, 53 for supporting the cable of winches or for supporting other equipment are mounted on the inner side of three different uprights 24 at their upper ends, beneath the safety light 32. All of the hooks have been load tested to 5,000 lbs. and meet ANSI A10.14-1991 safety specifications. If desired, one or more of the winches can be used to support persons who enter the manhole.

The trailer has five levelling stands 42, 43, 44, 45, 46 which can be rotatably adjusted to an appropriate height, depending upon the surface upon which the trailer rests. The front levelling stand 44 is configured to be raised in order to remove the towing vehicle.

The tow 13 is positioned at the front end of guard and support 10. The tow 13 can have any suitable attachment for a truck hitch, such as a pintle hitch or a ball hitch.

Figure 5:
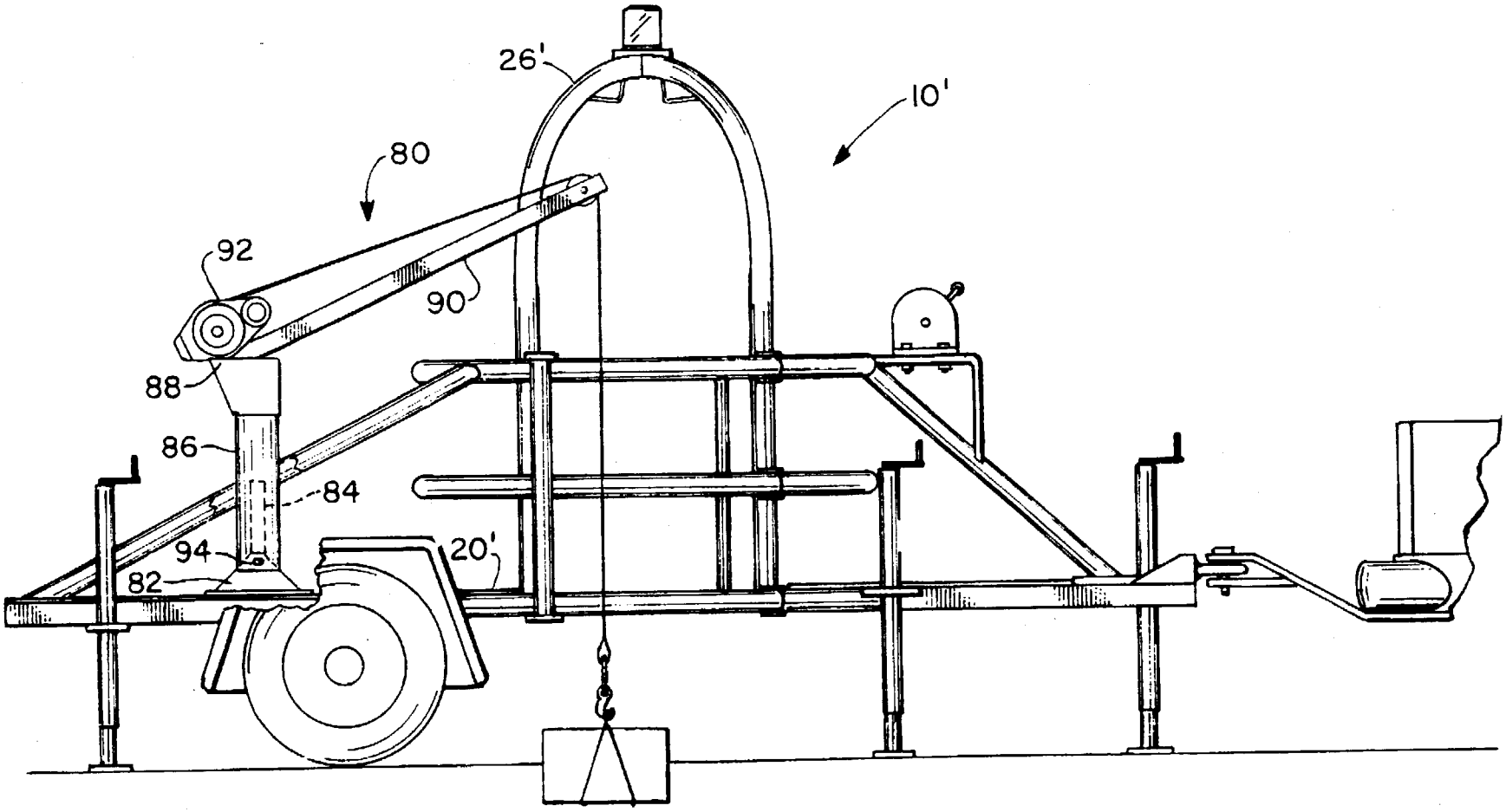
FIG. 5 is a side elevational view of a second preferred embodiment of a support frame according to the invention.

Another embodiment of the safety manhole guard and winch support is shown in FIG. 5 and is designated as 10'. This embodiment has the additional feature of a davit arm 80 mounted on the rear platform 20'. The davit arm 80 includes a base 82 which is bolted to rear platform 20'. Extending upward from the base 82 is a central vertical upright 84, over and around which is mounted a rotatable davit arm support post 86. Support post 86 rotatably supports a winch mount 88 having a horizontal platform upon which arm 90 is mounted. Winch mount 88 also supports winch 92. Arm 90 is rotatable around the sides and back of guard and support 10'. During transport of the guard and support 10', arm 90 is rotated to bear against an upright support post 26'. Rotation of support post 86 relative to vertical upright 84 is prevented by tightening bolt 94 at the base of winch support post 86. Davit arm 80 can be used to raise and lower persons and equipment over an edge, such as an edge of a large hole or pit, or a wall.

As will apparent to persons skilled in the art, various modifications and adaptations of the structure above described will become readily apparent without departure from the spirit and scope of the invention, the scope of which is defined in the appended claims.

What is claimed is:

1. An apparatus for use in vertically transporting a weight, comprising:

a trailer-type base configured to be towed by a vehicle, said base supporting wheels rollable on a ground surface, support means formed on and rigidly connected to the base, the support means having an igloo-shaped top which includes means for supporting a hoisting device, and stabilizing means extendable to contact the ground surface for stabilizing the support means.

2. An apparatus according to claim 1, further comprising barricade means formed on the base for preventing accidental entry into an area below the support means.

3. An apparatus according to claim 2, wherein the barricade means is part of the support means.

4. An apparatus according to claim 2, wherein the barricade means includes a cage-type barrier.

5. An apparatus according to claim 4, wherein the cage-type barrier has a door.

6. An apparatus according to claim 2, wherein the barricade means defines an opening positionable above a manhole.

7. An apparatus according to claim 6, wherein the barricade means has vertical uprights and horizontal rails for preventing accidental entry into the manhole.

8. An apparatus according to claim 1, further comprising platform means adjacent to the support means.

9. An apparatus according to claim 8, wherein the platform means is part of the base.

10. An apparatus according to claim 8, wherein the platform means includes a front platform configured to support a worker and a rear platform.

11. An apparatus according to claim 1, further comprising a hoisting device supported by the means for supporting a hoisting device.

12. An apparatus according to claim 1, further comprising a safety light mounted on the igloo-shaped top.

13. An apparatus according to claim 1, wherein the apparatus defines an opening positionable above a manhole.

14. An apparatus according to claim 1, further including rotatable support arm means mounted on the base for vertically transporting a weight over an edge.

15. An apparatus according to claim 14, wherein the rotatable support arm means includes a davit arm.

* * * * *